United States Patent [19]

Hoeh

[11] 3,996,487

[45] Dec. 7, 1976

[54] CERAMIC DISCHARGE LAMP WITH REDUCED HEAT DRAIN

[75] Inventor: Frederick W. Hoeh, Livingston, N.J.

[73] Assignee: Westinghouse Electric Corporation, Pittsburgh, Pa.

[22] Filed: May 14, 1975

[21] Appl. No.: 577,516

[52] U.S. Cl. ..... 313/25; 313/220; 313/318

[51] Int. Cl.[2] ..... H01J 61/30; H01J 61/52

[58] Field of Search ..... 313/25, 184, 324, 312, 313/220, 318

[56] References Cited

UNITED STATES PATENTS

| | | | |
|---|---|---|---|
| 2,135,718 | 11/1938 | Krefft et al. | 313/25 X |
| 2,545,884 | 3/1951 | Isaacs et al. | 313/25 X |
| 3,453,477 | 7/1969 | Hanneman et al. | 313/184 |
| 3,484,637 | 12/1969 | Van Boort et al. | 313/25 |
| 3,609,437 | 9/1971 | Tol et al. | 313/184 X |
| 3,623,134 | 11/1971 | Werner et al. | 313/184 X |
| 3,737,717 | 6/1973 | Arendash | 313/25 X |
| 3,855,494 | 12/1974 | Plagge | 313/184 |
| 3,885,184 | 5/1975 | Schat et al. | 313/318 |

*Primary Examiner*—Palmer C. Demeo
*Attorney, Agent, or Firm*—B. R. Studebaker

[57] ABSTRACT

An arc discharge lamp of the ceramic arc tube type wherein the mounting hardware for the arc tube at the end remote from the lamp base is significantly reduced in mass to eliminate an excessive heat sink characteristic and an expansion accommodating mounting is provided for the arc tube adjacent the base end of the lamp at the juncture of the base lead-in conductor and the arc tube lead.

6 Claims, 5 Drawing Figures

FIG.1
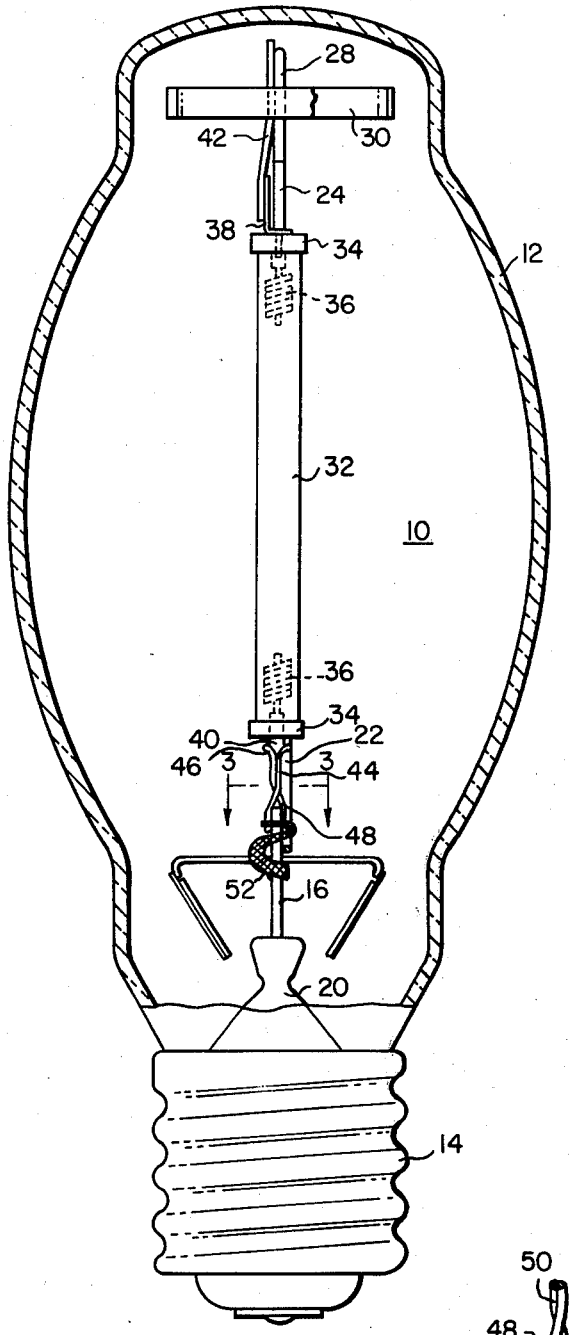
FIG.2
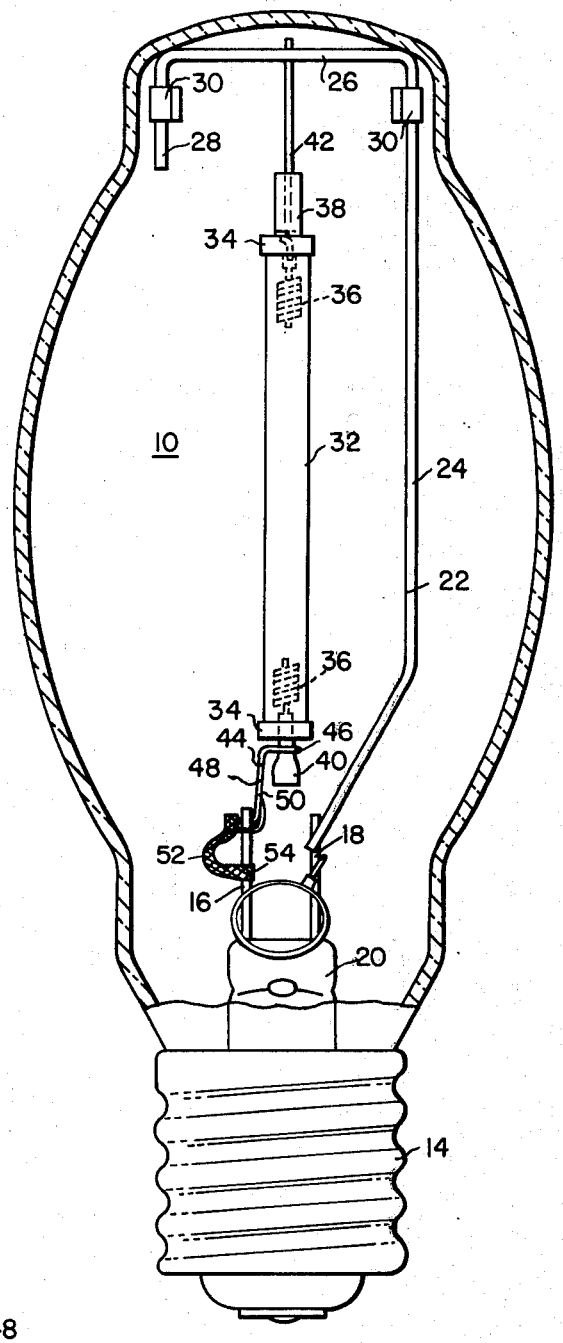
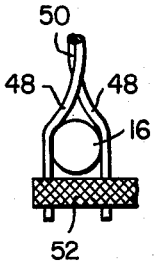
FIG.3

CERAMIC DISCHARGE LAMP WITH REDUCED HEAT DRAIN

BACKGROUND OF THE INVENTION

This invention relates to high pressure gas discharge lamps and more particularly to an improved mounting structure for high pressure discharge lamps employing ceramic arc tubes. Many high pressure sodium-mercury discharge lamps of the ceramic arc tube type of present manufacturer employ a "floating bridge" design at the top end of the lamp. This structure is somewhat similar to that disclosed in FIG. 4 of U.S. Pat. No. 3,623,134 with the exception that the cross-bar or "bridge" is welded to the tab on the end cap and permitted to slide with respect to the frame at the interconnection of the bridge and frame. The current structure then, consists of two parallel frame wire supports and a bridge of stainless steel slidable on the frame wires at its extremities and welded to the niobium tab on a nontubulated end cap, or to the tubulation should it be at that end of the lamp, adjacent its center. There is also a braided nickel ribbon welded both to the tab and to the frame wire to provide positive electrical connection between the upper end of the arc tube and the arc tube frame wires. The mass of the stainless steel bridge is substantial as well as that of the braided nickel ribbon which has a thermal conductivity of as high as 36 Btu/hr/sq.ft/° F/ft. with the tab conductivity being as high as 42. The heat from the end cap at the upper end of the lamp is readily dissipated, when the lamp is turned off, by conduction from the cap to the niobium tab to the bridge and braided ribbon and from there to the large wire frame. Radiation of heat from all of these members cools the upper end cap quickly and causes the sodium-mercury vapor to collect there as an amalgam. Since the lower end cap with the tubulation only involves a heat sink through a niobium connector wire to the lead in conductor of the stem, the bottom cap does not cool as rapidly. This lower support structure at the base end of the lamp is substantially as that disclosed in U.S. Pat. No. 3,855,494.

With the heat being dissipated from the upper end cap due to the much larger heat sink, most of the mercury and sodium in the vapor state condenses out at the top cap when the lamp is extinguished. Upon relighting the lamp, the arc has a tendency to strike the sodium amalgam as it melts and runs down from the top cap along the alumina side wall. This action subjects the polycrystalline alumina or sapphire arc tube to severe thermal stress which in turn can cause cracks in the polycrystalline alumina if the arc tube body is of marginal quality.

Accordingly, it is the object of this invention to collect most of the sodium-mercury vapor, as it condenses, at the bottom end of the arc tube when the lamp is turned off and is cooling down. Of course, it will be apparent, that this invention as disclosed is specifically directed to lamps which are designed to function in a base down orientation. Alternatively it will be equally apparent that the concepts of this invention could be practiced in a lamp designed for base up operation by merely reversing the structure to provide for a larger heat sink at the end of the lamp remote from the base.

SUMMARY OF THE INVENTION

The foregoing problems have been obviated by the present invention through reducing the mass and thermal conductivity of the supporting frame, eliminating the bridge and substituting therefor a thin wire in order to permit the top cap to hold its elevated temperature for a longer time and thereby encourage vapor to condense at the bottom cap of the arc tube. Additionally, some provision must be made to accomodate the expansion of the arc tube formerly accomodated by the floating bridge.

The foregoing is accomplished in accordance with the present invention, by providing in an arc discharge lamp of the ceramic arc tube type including a base, an outer glass envelope sealed to the base, and a pair of lead in conductors electrically connected to the base and extending into the outer envelope; an arc tube mounting frame including a vertical arm connected at one end thereof to one of the lead in conductors and extending for substantially the length of the outer glass envelope and terminating in a horizontal arm extending diametrically across the outer envelope adjacent to the top end remote from the lamp base. A ceramic arc tube including upper and lower refractory metal end closure members sealing off the ends thereof, is mounted to the horizontal arm of the mounting frame by a single axially oriented metal wire connecting the upper end closure thereto. The lower end closure member is connected to the other lead in conductor by a refractory metal looped lead in connector including a loop portion and a pair of leg portions with the loop portion surrounding the refractory metal exhaust and fill tubulation in the lower end cap in combination with a flexible lead wire connected at one end to the other lead in conductor and at its other end to the ends of the leg portions of the lead in connector. One of the flexible lead wires and the pair of leg portions of the loop lead in connectors surround the lead in conductor thereby substantially restricting lateral movement of the arc tube with respect to the outer envelope while permitting substantially free axial movement of one end of the arc tube to thereby accomodate expansion of the arc tube during operation of the lamp.

BRIEF DESCRIPTION OF THE DRAWING

Many of the attendant advantages of the present invention will become more readily apparent and better understood as the following detailed description of exemplary embodiments is considered in connection with the accompanying drawings in which:

FIG. 1 is front elevational view of one embodiment of ceramic discharge lamp constructed in accordance with this invention;

FIG. 2 is a side elevational view of the ceramic discharge lamp of FIG. 1;

FIG. 3 is a sectional view taken along the line 3—3 of FIG. 1;

DESCRIPTION OF THE PREFERRED EMBODIMENTS

Figure 5:
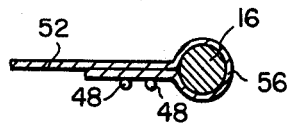
FIG. 5 is a sectional view taken along the line 5—5 of FIG. 4.

Referring now in detail to the drawing wherein like reference characters represent like parts throughout the several views, there is illustrated in FIGS. 1 and 2, one embodiment of the arc tube mounting structure of this invention. The ceramic discharge lamp generally designated 10 includes an outer envelope of glass 12 attached to a standard mogul base 14. A pair of lead in conductors 16, 18 are conventionally connected to the mogul base 14 and extend through a reentrant stem press 20 at the base of the envelope 12 in the conventional manner. Mounted on the upper end of lead in conductor 18 is the arc tube support frame 22 which serves both to retain and mount the arc tube within the outer envelope as well as conduct electricity to the upper electrode of the arc tube. The arc tube support frame 22 is substantially 7-shaped including the vertical arm 24 which extends for substantially the length of the outer glass envelope from its interconnection with the lead in conductor 18 and terminating in a horizontal arm portion 26 which extends diametrically across the outer envelope 12 adjacent the end thereof remote from the base 14. At the end of the horizontal arm 26 remote from its intersection with the vertical arm 24 is a downwardly directed short arm 28. Resilient spring members 30 are mounted on the short arm 28 and the upper end of the vertical arm 24 and serve to retain the frame 22 in a central location within the outer envelope 12 through resilient contact with the inner surface of the outer envelope.

A conventional ceramic arc tube 32 includes end closure members or end caps 34 sealing off the ends thereof and carrying on their inner surfaces arc supporting electrodes 36. The upper end cap 34 as illustrated in FIGS. 1 and 2 includes on its outer surface a mounting tab 38 to facilitate the mounting of the arc tube to the arc tube support frame 22. It will be apparent that the mounting tab 38 could equally be a piece of exhaust and fill tubulation as illustrated at 40 and employed in the preferred embodiment in connection with the lower end cap 34.

The upper end of the arc tube 32 is mounted to the arc tube support frame 22 by means of a single substantially axially oriented thin metal wire 42 which is preferably of stainless steel or nickel and is welded at one end to the horizontal arm 26 of the support frame 22 and at its other end to the arc tube mounting tab 38. This thin metal wire 42 provides a rigid connection between the support frame and the arc tube and will have a coefficient of thermal conductivity as low as 12 Btu/hr/sq.ft/° F/ft. substantially reducing the heat sink capabilities of the upper mount.

Since the support for the arc tube at the upper end of the lamp is now rigid, provision must be made to retain the arc tube centrally of the outer envelope by restricting its lateral movement while allowing for free axial movement of at least one end of the arc tube to accomodate logitudinal expansion of the arc tube during operation. The interconnection of the lower end cap 34 and its tubulation 40 to the other lead in conductor 16 extending from the stem press 20 exemplifies the novel arrangement of this invention for providing for the foregoing mount requirements.

One such construction is illustrated in FIGS. 1, 2, and 3 and involves a refractory metal looped lead in connector 44 including a looped portion 46 and a pair of leg portions 48. The looped portion 46 of the looped lead in connector 44 is brazed to the end cap tubulation 40 in the manner disclosed in U.S. Pat. No. 3,855,494. The leg portions 48 are crossed at 50 and a flexible lead wire 52 is welded at one end to the lead in conductor 16 and at its other end it is welded across the ends of the leg portions 48 of the looped lead in connector 44. As best seen in FIG. 3 the combination of the two leg portions 48 and the end of the flexible lead wire 52, which is in the form of a braided nickel lead, forms an enclosed loop which is in the form of a braided nickel lead, forms an enclosed loop which is slipped over the end of lead in conductor 16 to thereby provide the required floating mount at the lower end of the arc tube.

Figure 4:
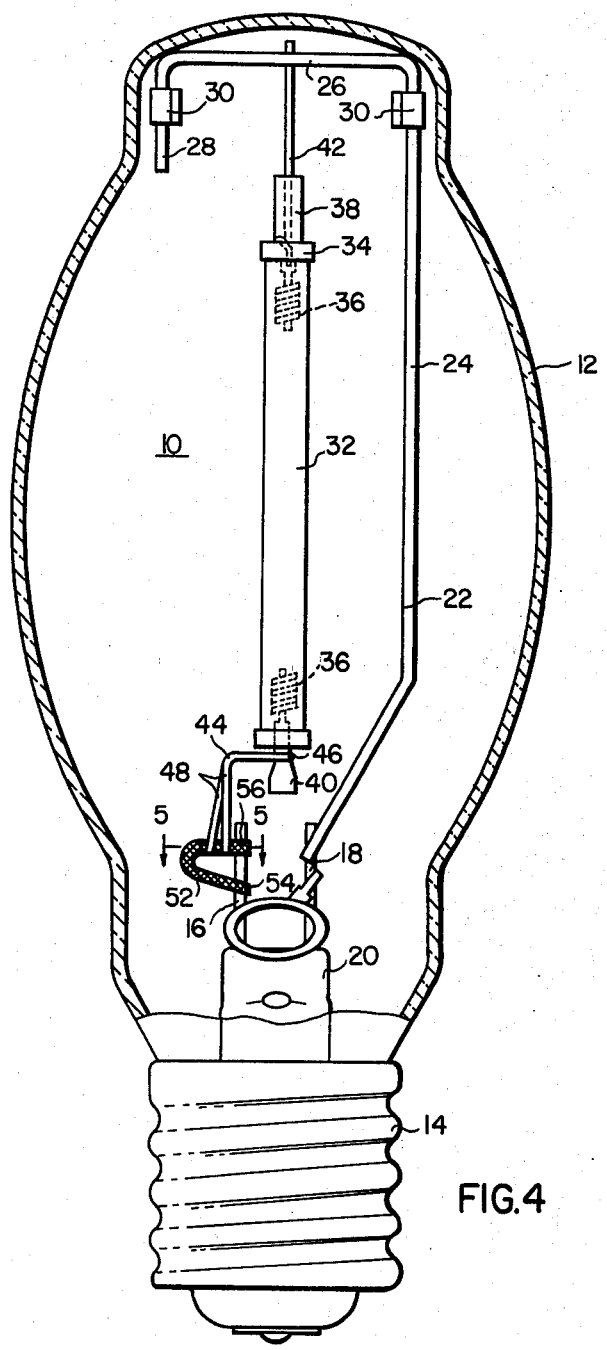
FIG. 4 is a side elevational view of an alternative embodiment of the ceramic discharge lamp of this invention.

An alternative embodiment is illustrated in FIGS. 4 and 5. In the embodiment of FIGS. 4 and 5 the flexible lead wire is again welded to the lead in conductor 16 at 54 with its other end 56 wrapped loosely around the lead in conductor 16 with the end thereof overlapping itself at which point the leg portions 48 of the looped lead in connector 44 are spot welded to the overlapping portion as best illustrated in FIG. 5, to again provide the floating mount at the lower end of the lamp.

As will be apparent from the foregoing, the ceramic discharge lamp construction of this invention significantly reduces the heat drain characteristics of upper mount area thus eliminating the condensation of sodium and mercury vapor on the upper end cap while further providing a novel floating mount at the lower end of the arc tube to accommodate any linear expansion of the arc tube body during operation of the lamp.

What is claimed is:

1. An arc discharge lamp of the ceramic arc tube type comprising:

a lamp base, an outer envelope sealed to said base, a pair of lead in conductors electrically connected to said base and extending into said outer envelope, a substantially 7-shaped mounting frame secured to one of said lead in conductors, a ceramic arc tube having refractory metal end closure members closing off the ends thereof and refractory metal exhaust and fill tubulation extending from at least one end closure member, a single axially oriented wire interconnecting the upper end closure member of said ceramic arc tube and the horizontal arm of said substantially 7-shaped mounting frame, thereby providing both support for and electrical connection to the upper end of said arc tube, a refractory metal looped lead in connector including a looped portion and a pair of leg portions, said looped portion surrounding said refractory metal exhaust and fill tubulation and brazed thereto; and a flexible lead wire connected at one end to said other of said lead in conductors and at its other end to the ends of the said leg portions of said looped lead in connector, one of said flexible lead wire and said pair of leg portions of said looped lead in connector surrounding said other lead in conductor to thereby substantially restrict lateral movement of said arc tube with respect to said outer envelope while permitting substantially free axial movement of one end of said arc tube to thereby accommodate expansion of said arc tube during operation of said lamp.

2. An arc discharge lamp according to claim 1 wherein the ends of said leg portions surround said lead in conductor and are connected to the end of said flexible lead wire.

3. The arc discharge lamp according to claim 1 wherein said flexible lead wire surrounds said lead in conductor and is welded to both itself and the leg portions of said looped lead in connector.

4. An arc discharge lamp of the ceramic arc tube type comprising:

a lamp base, an outer glass envelope sealed to said base, a pair of lead in conductors electrically connected to said base and extending into said outer envelope, an arc tube mounting frame including a vertical arm connected at one end thereof to one of said lead in conductors and extending for substantially the length of said outer glass envelope and terminating in a horizontal arm extending diametrically across said outer envelope adjacent to top end thereof remote from said lamp base, a ceramic arc tube including upper and lower refractory metal end closure members sealing off the ends thereof, a single axially oriented metal wire connecting said upper end closure member to said horizontal arm of said mounting frame, said single metal wire providing both electrical connection between said frame and said arc tube and the sole support of the upper end of said arc tube, and means electrically connecting the lower end closure to the other of said lead in connectors, said means including a refractory metal looped lead in connector having a looped portion and a pair of leg portions, and a flexible lead wire, said looped portion of said looped lead in connector connected to said lower end closure member and said flexible wire connected at one end to the other of said lead in conductors with one of said flexible lead wire and said pair of leg portions of said looped in connector surrounding said other lead in conductor to thereby substantially restrict lateral movement of said arc tube with respect to said outer envelope while permitting axial movement of one end of said arc tube to thereby accomodate expansion of said arc tube during operation of said lamp.

5. An arc discharge lamp according to claim 4 wherein the ends of said leg portions surround said lead in conductor and are connected to the end of said flexible lead wire.

6. The arc discharge lamp according to claim 4 wherein said flexible lead wire surrounds said lead in conductor and is welded to both itself and the leg portions of said looped lead in connector.

* * * * *